US012534973B2

(12) United States Patent
Madan et al.

(10) Patent No.: US 12,534,973 B2
(45) Date of Patent: Jan. 27, 2026

(54) DOWNHOLE TOOL

(71) Applicant: SAUDI ARABIAN OIL COMPANY, Dhahran (SA)

(72) Inventors: Mohammed Madan, Dhahran (SA); Mahdy Jezany, Dhahran (SA); Abdullah Alshooq, Dhahran (SA); Talal A. Shihabuddin, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/659,934

(22) Filed: May 9, 2024

(65) Prior Publication Data

US 2025/0347193 A1 Nov. 13, 2025

(51) Int. Cl.

| | |
|---|---|
| ***E21B 33/138*** | (2006.01) |
| ***E21B 23/00*** | (2006.01) |
| ***E21B 33/12*** | (2006.01) |
| ***E21B 43/112*** | (2006.01) |

(52) U.S. Cl.

CPC ..... *E21B 33/138* (2013.01); *E21B 23/00* (2013.01); *E21B 33/12* (2013.01); *E21B 33/1208* (2013.01); *E21B 43/112* (2013.01)

(58) Field of Classification Search

CPC ..... E21B 33/138; E21B 23/00; E21B 33/12; E21B 33/1208; E21B 43/112

See application file for complete search history.

(56) References Cited

U.S. PATENT DOCUMENTS

| | | | | |
|---|---|---|---|---|
| 2,638,165 | A * | 5/1953 | Barber | E21B 43/112 166/212 |
| 5,311,939 | A * | 5/1994 | Pringle | E21B 33/1292 166/134 |
| 7,017,672 | B2 | 3/2006 | Owen, Sr. | |
| 8,136,584 | B2 | 3/2012 | Burnett et al. | |
| 9,279,307 | B2 | 3/2016 | Williamson | |
| 2009/0194277 | A1* | 8/2009 | Burnett | E21B 23/0414 166/55.1 |
| 2009/0294137 | A1* | 12/2009 | Meijer | E21B 33/1295 166/120 |
| 2019/0316449 | A1* | 10/2019 | Schultz | E21B 23/08 |

* cited by examiner

*Primary Examiner* — Tara Schimpf
*Assistant Examiner* — Daniel T Craig
(74) *Attorney, Agent, or Firm* — Vorys, Sater, Seymour and Pease, LLP

(57) ABSTRACT

A downhole tool includes a plugging portion including a plug transitionable between a running state, where the plug is retracted and allows the downhole tool to traverse an interior of production tubing, and a plugging state, where the plug expands radially outward to sealingly engage an inner wall of the production tubing. A perforating portion is operatively coupled to the plugging portion and provides a housing that houses a perforating device actuatable to penetrate the inner wall of the production tubing and thereby generate a perforation through which a kill fluid may be circulated into an annulus surrounding the production tubing.

20 Claims, 6 Drawing Sheets

DOWNHOLE TOOL

FIELD OF THE DISCLOSURE

The present disclosure relates generally to a downhole well intervention operations and, more particularly, to a downhole tool for preparing a well for well killing by plugging and perforating production tubing in an oil well to create a desired flow path for kill fluid.

BACKGROUND OF THE DISCLOSURE

To meet safety requirements during various oil and gas operations, including various workover and securement operations, it is necessary to regain control of the flow of formation fluids by killing a well. Killing a well involves introducing a fluid with a relatively high density, known as kill fluid, into the well to counter formation pressure. As kill fluid is pumped into the well, existing fluids are circulated to the surface and/or formation fluids are pushed back towards the formation. The result of killing a well is that formation pressure and bottomhole pressure are balanced, thus removing the risk of uncontrolled flow of formation fluids into the well.

Kill fluid can be pumped into the well via production tubing or via the space or annulus between the production tubing and the wellbore casing. The choice is dependent on well configuration, formation conditions, well integrity, kill fluid properties and well control objectives. In some cases, it is necessary to create specific flow paths for the kill fluid to improve circulation and distribution thereof through the well. This is achieved by placing plugs or seals within the wellbore and making perforations in the production tubing at specific depths above the plugs. In cases where kill fluid is pumped down the production tubing, a perforation is made at a desired depth and a plug is set beneath the perforation to guide the kill fluid into the annulus at the desired location.

Currently, to perforate and plug the production tubing, a first run is made to lower a perforation tool into the production tubing to create a perforation, and a second run is made to lower a plugging tool to set a plug in the production tubing below the perforation. However, due to the significant depth of oil wellbores, undertaking separate runs to lower two separate tools to perforate and plug the tubing is time consuming and costly.

What is needed, therefore, is a downhole tool that is capable of both plugging and perforating the production tubing in a single run to reduce the time taken to prepare a well for the introduction of kill fluid.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a downhole tool is disclosed and includes a plugging portion including a plug transitionable between a running state, where the plug is retracted and allows the downhole tool to traverse an interior of production tubing, and a plugging state, where the plug expands radially outward to scalingly engage an inner wall of the production tubing, and a perforating portion operatively coupled to the plugging portion and providing a housing that houses a perforating device actuatable to penetrate the inner wall of the production tubing and thereby generate a perforation through which a kill fluid may be circulated into an annulus surrounding the production tubing.

According to another embodiment consistent with the present disclosure, a method for preparing a well for the introduction of a kill fluid is disclosed and includes the step of conveying a downhole tool into production tubing on a conveyance extended from a surface installation, the production tubing being arranged within a wellbore extending from the surface installation and the downhole tool including a plugging portion including a plug transitionable between a running state, where the plug is retracted and allows the downhole tool to traverse an interior of the production tubing, and a plugging state, where the plug expands radially outward to sealingly engage an inner wall of the production tubing, and a perforating portion operatively coupled to the plugging portion and providing a housing that houses a perforating device. The method may further include lowering the downhole tool to a predetermined depth within the production tubing, transitioning the plug from the running state to the plugging state and thereby sealingly engaging the inner wall of the production tubing, and actuating the perforating device and thereby generating a perforation in the inner wall.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
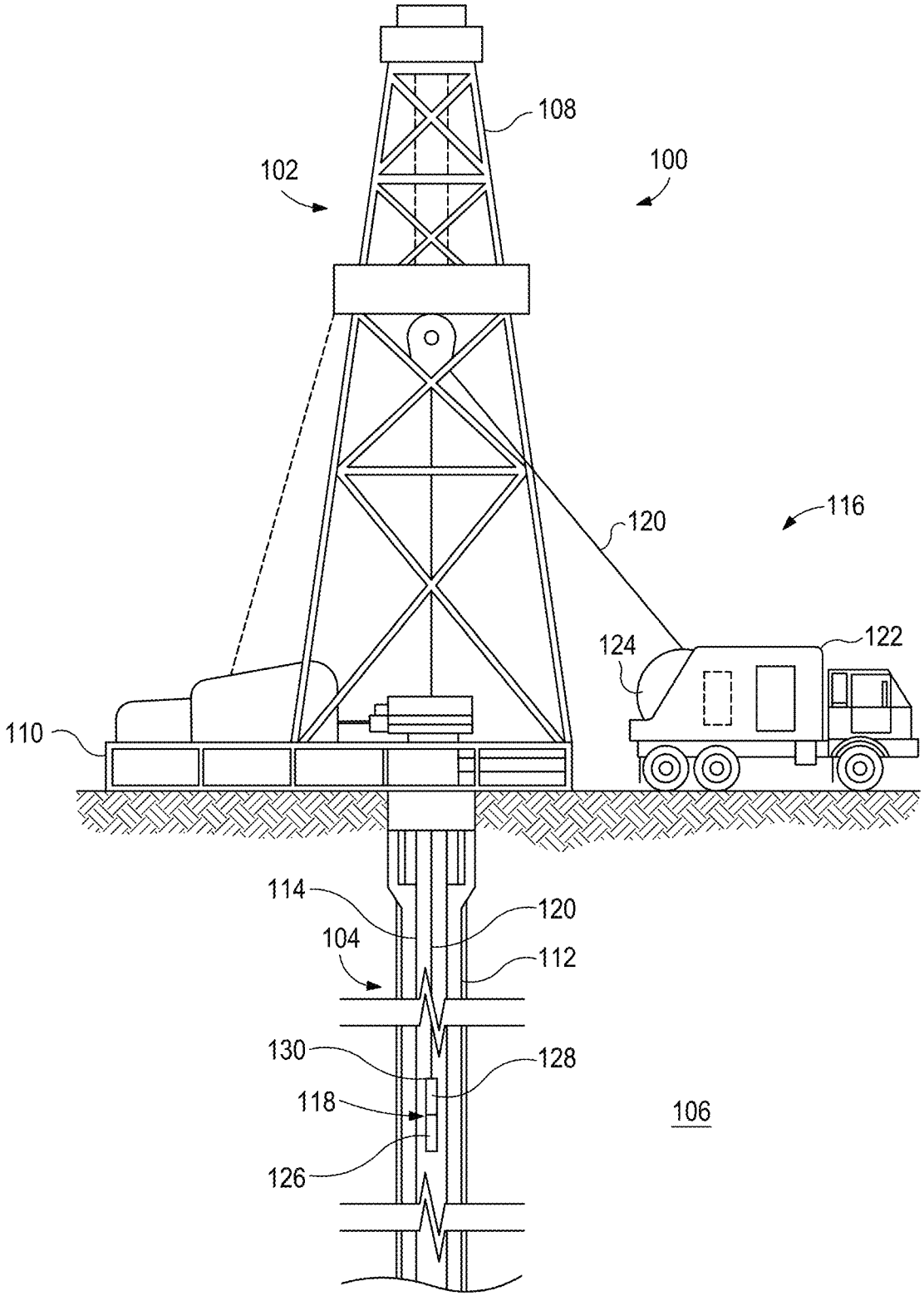
FIG. 1 is a schematic diagram of an example well system that may employ the principles of the present disclosure, according to one or more embodiments.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to a downhole well intervention operations and, more particularly, to a downhole tool for preparing a well for a well killing operation by plugging and perforating production tubing in an oil well, and thereby creating a desired flow path for kill fluid in a single run. As compared to conventional multi-run methods, the downhole tool of the present disclosure combines a plugging tool and a perforating tool so that preparation of the well can be carried out in a single run, significantly reducing the time taken to prepare the well for the introduction of kill fluid.

FIG. 1 is a schematic diagram of an example well system 100 that may employ the principles of the present disclosure, according to one or more embodiments. As illustrated, the well system 100 includes a surface installation 102 positioned at the Earth's surface (e.g., a "well surface location") and a wellbore 104 which extends from the surface installation 102 and penetrates one or more subterranean formations 106. In some embodiments, as illustrated, the surface installation 102 may comprise a service rig that includes a derrick 108 supported by a surface-mounted platform 110. In other embodiments, however, the surface installation 102 may comprise a wellhead or the like. Moreover, while the well system 100 is depicted as a land-based operation, it will be appreciated that the principles of the present disclosure could equally be applied in any offshore, sca-based, or sub-sea application where the surface installation 102 may be implemented with a floating platform, a semi-submersible platform, or a sub-surface wellhead installation, as generally known in the art.

A portion of the wellbore 104 may be lined with a string of casing 112, which may be secured in place within the wellbore 104 using cement. Further, production tubing 114 may be extended downhole within the casing 112. The well system 100 may further include a conveyance system 116 operable to convey a downhole tool 118 into the production tubing 114 on a conveyance 120. The conveyance 120 may include, but is not limited to, wireline, electric line (or "E-line"), slickline, wired slickline, coiled tubing, wired coiled tubing, or any combination thereof. Preferably, the conveyance 120 comprises slickline or wireline. In some embodiments, as illustrated, the conveyance 120 may be dispensed from a surface-mounted wireline unit 122 (e.g., a truck or the like) having a drum 124 on which the conveyance 120 may be wound and unwound.

The downhole tool 118 may be used to help prepare the wellbore 104 for the introduction of a kill fluid. As illustrated, the downhole tool 118 may include a plugging portion 126 and a perforating portion 128. As described in more detail below, the plugging portion 126 may be operable to set a plug 236 (see FIGS. 2 and 3) within the production tubing 114, and the perforating portion 128 may be operable to perforate the production tubing 114 above the plug 236 and thereby create a flow path for the kill fluid. The downhole tool 118 may further include a connecting arrangement 130 configured to facilitate connection of the downhole tool 118 to the conveyance 120 and thereby facilitate displacement of the downhole tool 118 within the production tubing 114.

Figure 2:
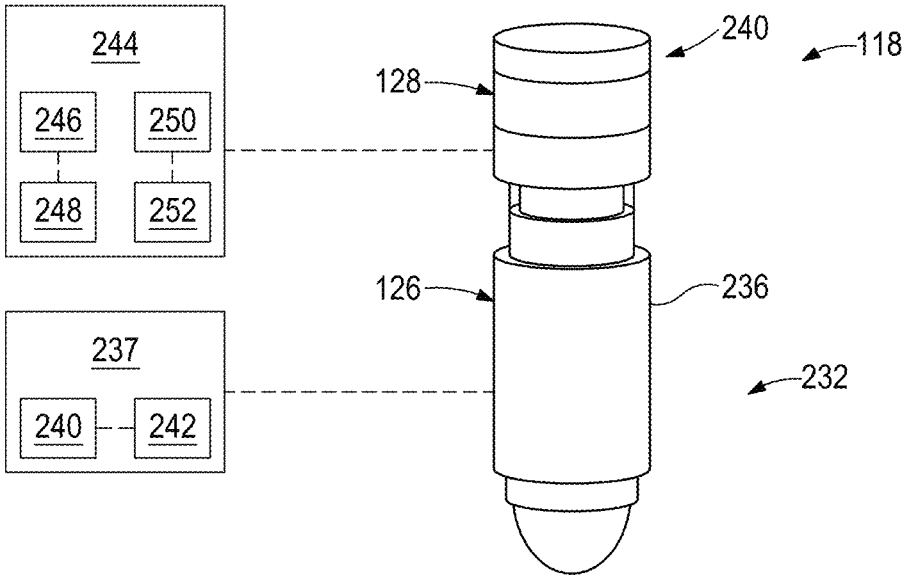
FIGS. 2 and 3 are schematics showing a downhole tool in an inoperative lowering condition and an operative expanded condition, respectively.
Figure 3:
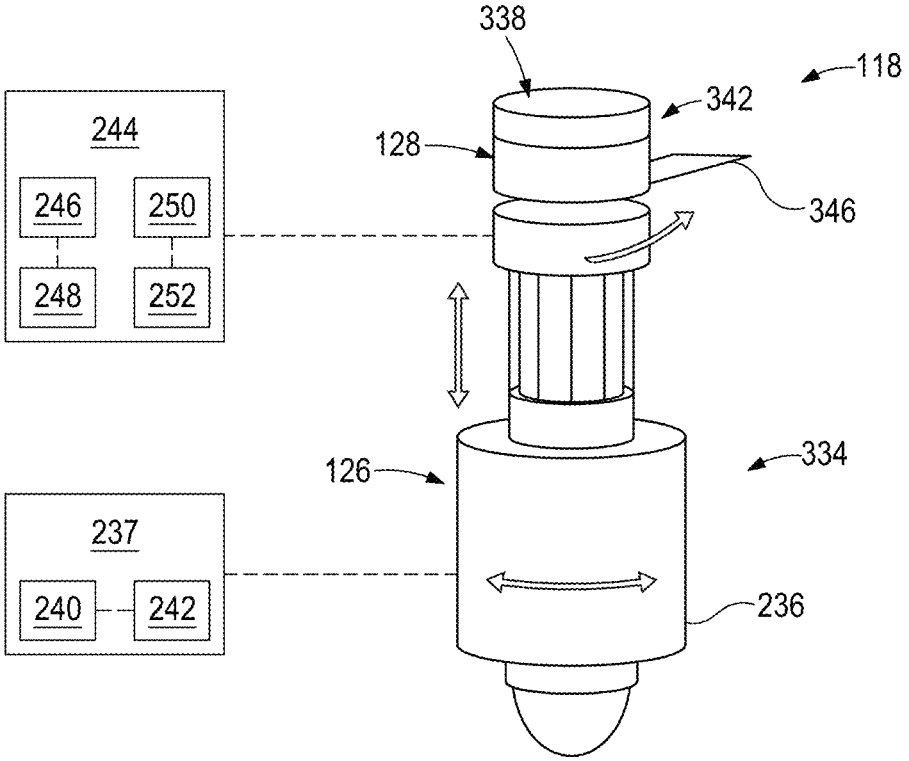

FIGS. 2 and 3 are enlarged, schematic views of the downhole tool 118, according to one or more embodiments. The downhole tool 118 may be actuatable from a first or "running" state 232, as shown in FIG. 2, to a second or "plugging" state 334, as shown in FIG. 3. In particular, the plugging portion 126 may include an expandable plug 236 and a plug displacement mechanism 237 for transitioning the plug 236 between the running state 232, where the plug 236 is contracted and thus allows the downhole tool 118 to traverse the production tubing 114 (FIG. 1), and the plugging state 334, where the plug 234 is expanded to seal against an inner wall of the production tubing 114. When the downhole tool 118 is transitioned to the plugging state, fluid flow past the plugging portion 126 (in either direction) is substantially or entirely inhibited.

In some embodiments, the plug 236 may be manufactured from a resiliently deformable material for allowing expansion and contraction between the running and plugging states, respectively. The plug 236 may be made of rubber, for example. In at least one embodiment, the plug 236 may comprise a wellbore packer or plug. In some embodiments, the plug displacement mechanism 237 may include an inner cavity and an opening for allowing fluid flow into or out of the inner cavity to enable transition of the plug 236 from the running state 232 to the plugging state 334. More specifically, the downhole tool 118 may include an inner mandrel that can be forced against the plug 236 (e.g., hydraulically), thereby causing the plug 236 to expand radially outward and into sealing engagement with an adjacent inner wall of the production tubing 114 (FIG. 1). In other embodiments, however, the plug 236 may comprise an inflatable packer assembly, without departing from the scope of the disclosure. Generally speaking, the downhole tool 118 may include a motor powered by one or more onboard power sources (e.g., batteries, fuel cells, etc.), and actuating the plug 236 between the running and plugging states may entail triggering operation of the motor to radially expand the plug 236.

In some embodiments, the plug displacement mechanism 237 may be reversible. In embodiments that include the motor and onboard power source(s), reversing operation of the plug displacement mechanism 237 may entail triggering operation of the motor to allow the plug 236 to radially contract to the running state. In other embodiments, or in addition thereto, a valve assembly may be operable to reverse the direction of fluid flow through the plug displacement mechanism 237, and thereby return the plug 236 back to the running state 232. Displacement of the valve assembly (or valves thereof) may be carried out electronically or mechanically.

In some embodiments, the plug displacement mechanism 237 may include a plug controller 240 operable to control operation of the plug displacement mechanism 237. In at least one embodiment, the plug controller 240 may include a plug control timer 242 configured to activate the plug displacement mechanism 237 after a predetermined time. The predetermined time may be an estimated time required to lower the downhole tool 118 to a particular depth. Once the predetermined amount of time elapses, the plug controller 240 may activate the plug displacement mechanism 237, thereby causing transition (expansion) of the plug 236 to the plugging state 334 where the plug 236 is firmly secured against the inner wall of the production tubing 114 (FIG. 1).

The perforating portion 128 may include a perforating device mounted within a housing 338. In some embodiments, the perforating device may comprise a blade 346 displaceable between a stowed state 240, as shown in FIG.

2, and an extended state 342, as shown in FIG. 3. In the stowed state, the blade 346 may be secured within a pocket or grooved defined in the outer periphery of the housing 338. When transitioned to the extended state 342, the blade 346 is pivoted away from the housing 338 and into engagement with the adjacent inner wall of the production tubing 114 (FIG. 1). The blade 346 may be manufactured from a material with suitable hardness, toughness and wear resistance to penetrate the production tubing 114 (FIG. 1). The material may include any of the group including high-speed steel, stainless steel, tool steel, advanced ceramics, reinforced polymers, carbide, tungsten, tungsten carbide, preferably being manufactured from tungsten carbide.

The perforating portion 128 may include a perforator displacement mechanism 244 operable to displace (actuate) the blade 346 into engagement with the wall of the production tubing 114 (FIG. 1) in order to create a perforation. The perforator displacement mechanism 244 may be configured to displace the blade 346 along the production tubing wall to create a perforation which extends in the range of 30 degrees to 180 degrees about the downhole tool 118, preferably being configured to create a perforation which extends in the region of 180 degrees about the downhole tool 118. The perforator displacement mechanism 244 may be configured to retract the blade 346 once the perforation is made. Thereafter, the housing 338 may be transitioned from the extended state 342 back to the stowed state 240 in order to return the blade 346 into the housing 338.

The perforator displacement mechanism 244 may include a perforator drive assembly 246, which may comprise an electric motor operable to extend the blade 346 to perforate the production tubing 114 (FIG. 1). The perforator displacement mechanism 244 may further include a power supply 248 for supplying power to the perforator drive assembly 246. In some embodiments, the power supply 248 may comprise one or more batteries or fuel cells. In at least one embodiment, the power supply 248 may also provide power to the plug displacement mechanism 237.

A perforator controller 250 may be provided for controlling operation of the perforator displacement mechanism 244. The perforator controller 250 may include a perforator timer 252 configured to activate the perforator displacement mechanism 244 after a predetermined time. In some embodiments, the perforator controller 250 may communicate with the plug controller 240 for allowing receipt of a completion signal from the plug controller 240, indicating that the plug 236 is secured in position. In at least one embodiment, the perforator timer 252 may be activated upon receipt of the completion signal. The predetermined time may be an estimated amount of time to permit disconnection between the downhole tool 118 and the conveyance 120 (FIG. 1).

Figure 4:
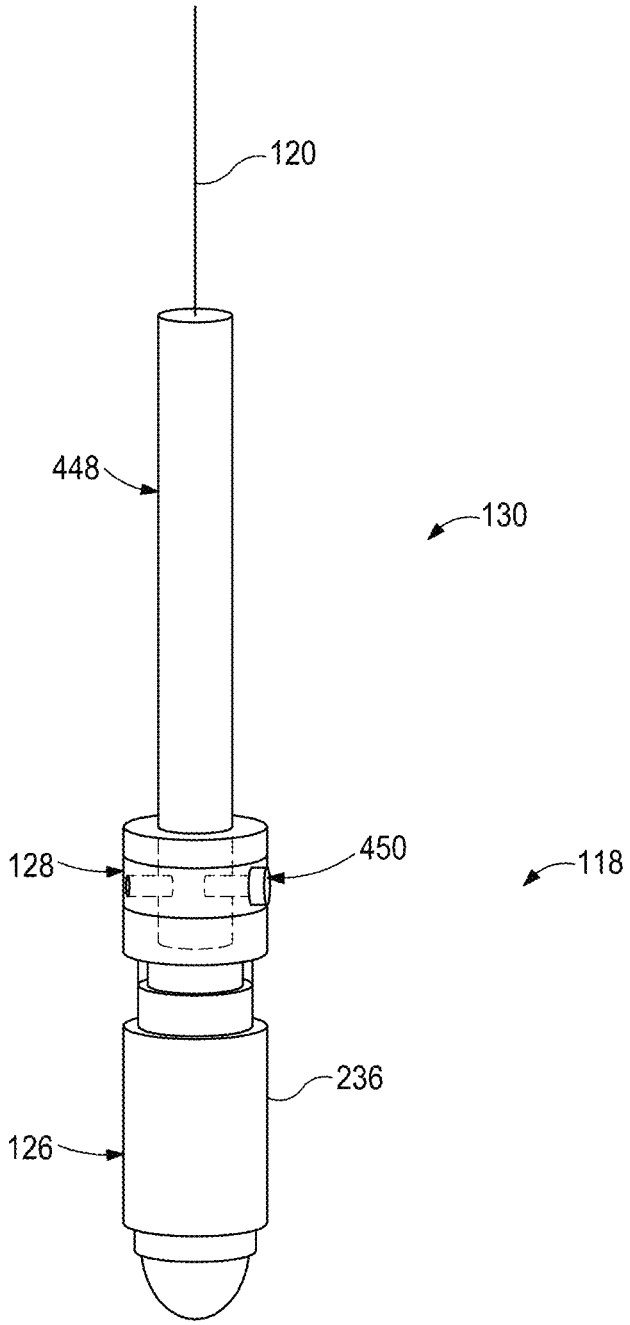
FIG. 4 is a schematic showing how the downhole tool of FIGS. 2-3 is connected to a conveyance for lowering the downhole tool.

Referring now to FIG. 4, illustrated is an enlarged schematic view of the downhole tool 118 operatively coupled to a running tool 448, according to one or more embodiments. More specifically, the connecting arrangement 130 includes the running tool 448 operatively coupled to the downhole tool 118 and further operatively coupled to the conveyance 120. As illustrated, the connecting arrangement 130 may include a frangible connector 450 that releasably couples the running tool 448 to the top of the downhole tool 118. The frangible connector 450 may be in the form of a pin, such as a shear pin, and may be configured to break (shear) after the plug 236 is set and when the running tool 448 is pulled via the conveyance 120 with sufficient force. Shearing the frangible connector 450 will free the running tool 448 from the downhole tool 118, thereby allowing the running tool 448 to be returned to the well surface.

Figures 5A, 5B, 5C, 5D, 5E, 5F, 5G:
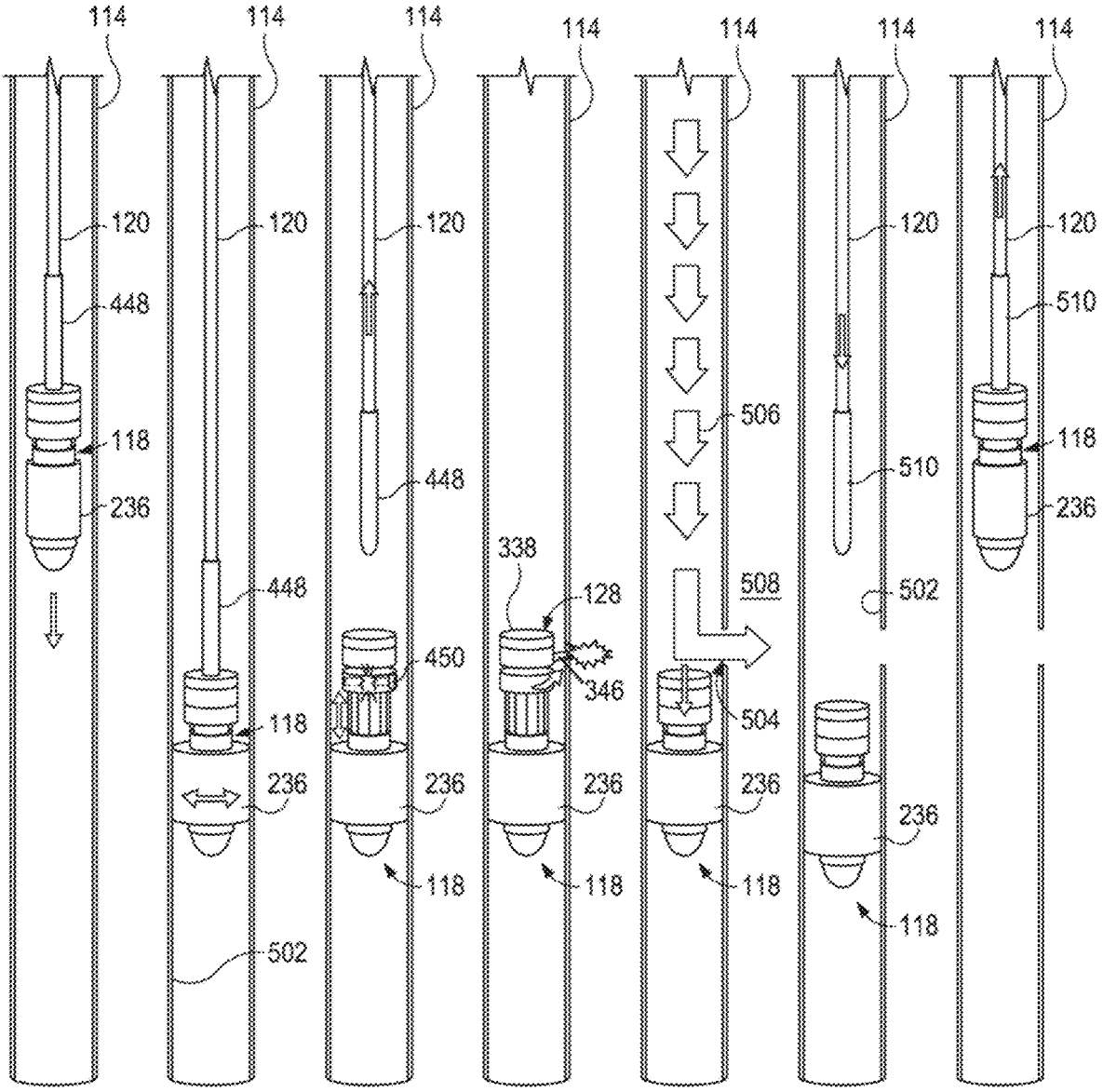
FIGS. 5A-5G are schematic views of the downhole tool showing progressive operation, according to one or more embodiments.

FIGS. 5A-5G are schematic views of the downhole tool 118 showing progressive operation, according to one or more embodiments. In FIG. 5A, the downhole tool 118 is conveyed into the production tubing 114 on the conveyance 120. The running tool 448 may be used to operatively couple the downhole tool 118 to the conveyance 120. Prior to running the downhole tool 118 into the production tubing 114, the plug control timer 242 (FIGS. 2-3) may be set with a first predetermined time period to allow sufficient time to lower the downhole tool 118 to a desired (predetermined) depth.

In FIG. 5B, the downhole tool 118 has reached the predetermined depth and the well operator maintains the downhole tool 118 stationary. After the first predetermined time period set by the plug control timer 242 (FIGS. 2-3) elapses, the plug controller 240 (FIGS. 2-3) may activate the plug displacement mechanism 237 (FIGS. 2-3) to transition the plug 236 from the running state 232 (FIG. 2) to the plugging state 334 (FIG. 3). Transitioning the plug 236 to the plugging state 334 will cause the plug 236 to sealingly engage an inner wall 502 of the production tubing 114. Moreover, once the plug 236 transitions to the plugging state 334, the plug controller 240 (FIGS. 2-3) may transmit a completion signal to the perforator controller 250 (FIGS. 2-3) to activate the perforator control timer 252 (FIGS. 2-3). The perforator control timer 252 (FIGS. 2-3) may be set with a second predetermined time period to allow sufficient time to allow the running tool 448 to be detached from the downhole tool 118.

In FIG. 5C, the running tool 448 is shown detached from the downhole tool 118. As described above, the running tool 448 may be detached from the downhole tool 118 by shearing the frangible connector 450, which frees the running tool 448 from the downhole tool 118. The running tool 448 may then be returned to the well surface on the conveyance 120.

In FIG. 5D, once the second predetermined time period has elapsed, the perforator controller 250 (FIGS. 2-3) may activate the perforator displacement mechanism 244 (FIGS. 2-3) to cause the blade 346 to actuate or "fire". Actuating the blade 346 drives the blade 346 into engagement with the inner wall 502, thereby resulting in the creation of a perforation 504 defined in the inner wall 502. Once the perforation 504 is made, the blade 346 may be retracted back into the housing 338. In some embodiments, an hour is dedicated to allow the perforation 504 to be made. If the perforating portion 128 fails to create the perforation 504 within the time provided, the blade 346 will automatically retract and the downhole tool 118 may be retrieved to the well surface and re-set at surface to allow the process to be restarted.

In FIG. 5E, once the perforation 504 is successfully created, a kill fluid 506 may be pumped into the production tubing 114 and exit the production tubing 114 through the perforation 504 to begin the well killing process. The kill fluid 506 is discharged into the surrounding annulus 508, and once the bottomhole pressure and the formation pressure are balanced, the well can be considered "killed".

In FIG. 5F, once it is verified that the well is successfully "killed," a retrieving tool 510 may be conveyed into the production tubing 114 on the conveyance 120. As described in more detail below, the retrieving tool 510 may be configured to locate and mate with the top of the downhole tool 118. Once the retrieving tool 510 properly mates with the downhole tool 118, overpull may be applied to the downhole tool 118 via the conveyance 120, which causes the plug displacement mechanism 237 (FIGS. 2-3) to reverse operation and transition the plug 236 from the plugging state 334 (FIG. 3) back to the running state 232 (FIG. 2).

In FIG. 5G, once the plug 236 has returned to the running state 232 (FIG. 2), the downhole tool 118 will be free from sealed engagement with the production tubing 114. The downhole tool 118 may then be conveyed back to the well surface as attached to the conveyance 120.

Figure 6:
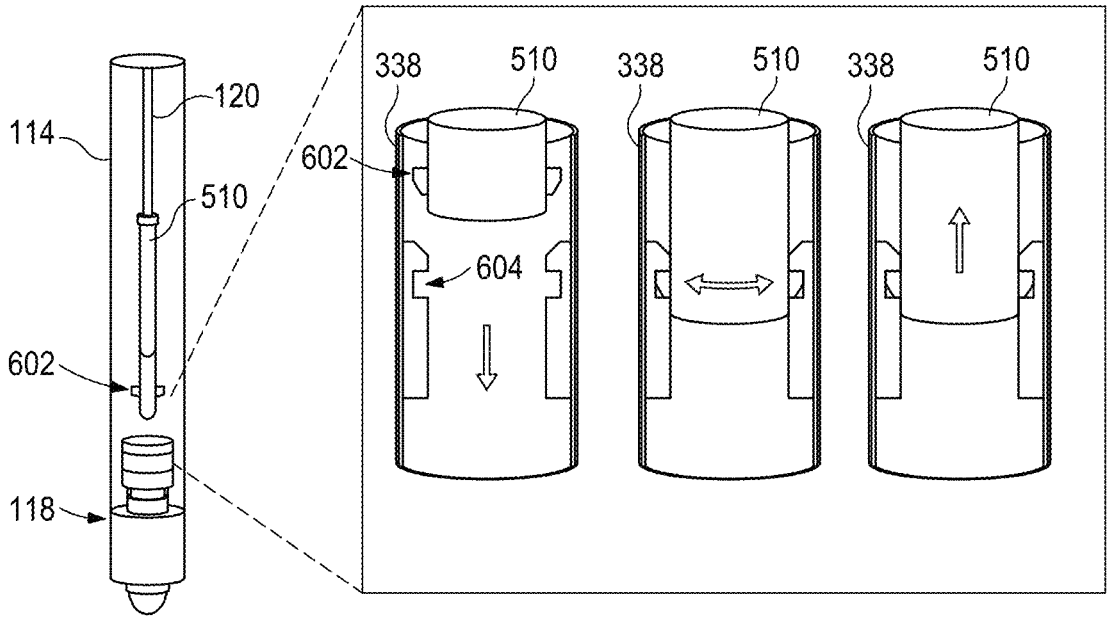
FIG. 6 is a schematic view of the retrieving tool engaging the downhole tool 118, according to one or more embodiments.

FIG. 6 is a schematic view of the retrieving tool 510 engaging the downhole tool 118, according to one or more embodiments. In particular, FIG. 6 depicts a schematic view of the retrieving tool 510 advancing toward the downhole tool 118, and enlarged, progressive views of example operation of operatively coupling the retrieving tool 510 to the downhole tool 118. As indicated above, the retrieving tool 510 may be conveyed into the production tubing 114 on the conveyance 120 until reaching the downhole tool 118. As illustrated, the retrieving tool 510 may provide a latching mechanism 602 configured to locate and mate with a corresponding profile 604 (e.g., a GS profile) provided by the downhole tool 118. The profile 604 may be provided within the housing 338, and the distal end of the retrieving tool 510 may be sized to be received within the housing 338 to locate the profile 604.

Once the latching mechanism 602 properly locates and is received within the profile 604, an uphole force may be applied to the downhole tool 118 via the conveyance 120. Providing the uphole force (e.g., an overpull force) on the downhole tool 118 at the profile 118 will cause the plug displacement mechanism 237 to reverse and transition the plug 236 from the plugging state 334 (FIG. 3) back to the running state 232.

Figure 7:
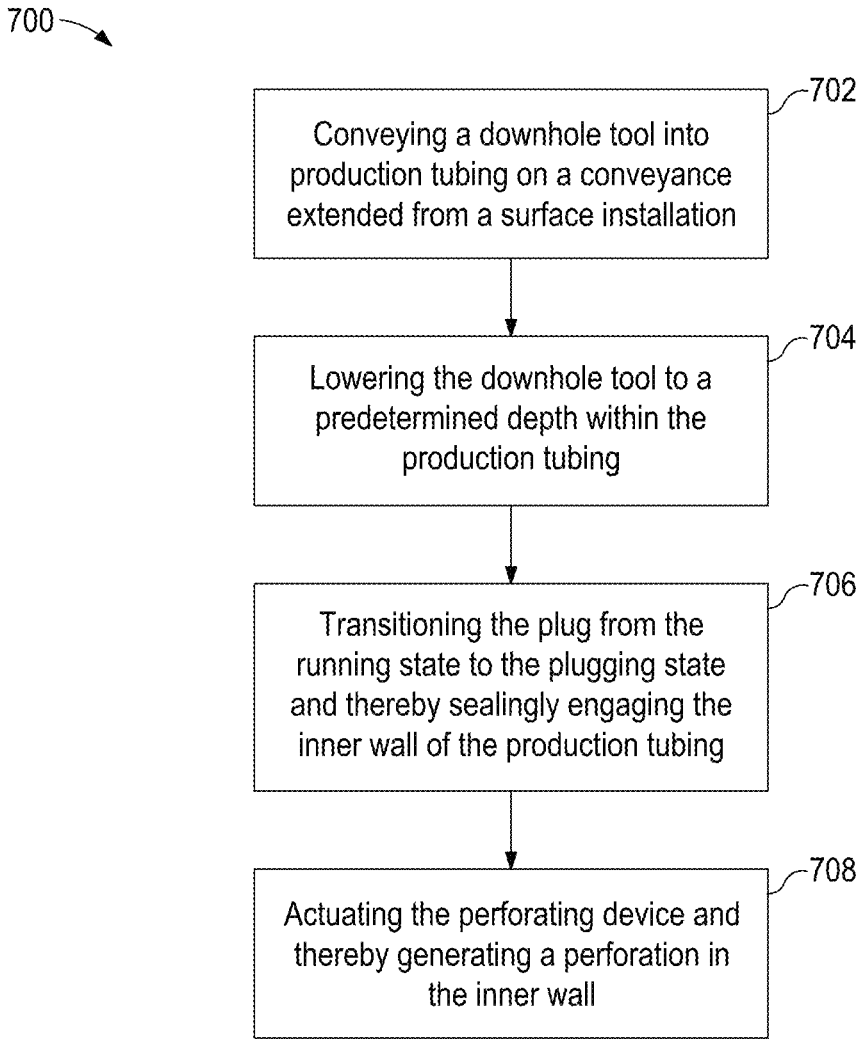
FIG. 7 is a schematic flowchart of an example method for preparing a well for kill fluid using the downhole tool, according to one or more embodiments disclosed herein.

FIG. 7 is a schematic flowchart of an example method 700 for preparing a well 115 for the introduction of kill fluid using the downhole tool 118, in accordance with the principles of the present disclosure. The method 700 may include conveying a downhole tool into production tubing on a conveyance extended from a surface installation, as at 702. The production tubing may be extended within a wellbore extending from the surface installation and, as described herein, the downhole tool may include a plugging portion and a perforating portion. The plugging portion may include a plug transitionable between a running state, where the plug is retracted and allows the downhole tool to traverse an interior of the production tubing, and a plugging state, where the plug expands radially outward to sealingly engage an inner wall of the production tubing. The perforating portion may be operatively coupled to the plugging portion and may provide a housing that houses a perforating device.

The method 700 may further include lowering the downhole tool to a predetermined depth within the production tubing, as at 704. Once at the predetermined depth, the method 700 may further include transitioning the plug from the running state to the plugging state and thereby sealingly engaging the inner wall of the production tubing, as at 706. The method 700 may then include actuating the perforating device and thereby generating a perforation in the inner wall, as at 708.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A downhole tool, comprising:

a plugging portion including a plug transitionable between a running state, where the plug is retracted and allows the downhole tool to traverse an interior of production tubing, and a plugging state, where the plug expands radially outward to sealingly engage an inner wall of the production tubing;

a plug displacement mechanism included in the plugging portion and operable to transition the plug between the running and plugging states, the plug displacement mechanism including:

a plug controller operable to control operation of the plug displacement mechanism; and a plug control timer in communication with the plug controller and configured to activate the plug displacement mechanism via the plug controller after expiration of a predetermined time period; and a perforating portion operatively coupled to the plugging portion and providing a housing that houses a perforating device actuatable to penetrate the inner wall of the production tubing and thereby generate a perforation through which a kill fluid may be circulated into an annulus surrounding the production tubing, wherein the housing is translatable relative to the plugging portion between a first axial position and a second axial position, and wherein the perforating device is actuatable to penetrate in the inner wall while the housing is in the second axial position.

2. The downhole tool of claim 1, wherein the plug displacement mechanism is reversible to transition the plug from the plugging state back to the running state.

3. The downhole tool of claim 1, wherein the predetermined time period is an estimated time required to lower the downhole tool to a predetermined depth within the production tubing.

4. The downhole tool of claim 1, wherein the perforating device comprises a blade and the perforation extends about 30 degrees to about 180 degrees about the inner wall of the production tubing.

5. The downhole tool of claim 1, wherein the perforating portion includes a perforator displacement mechanism operable to actuate the perforating device and including:

a power supply for supplying power to the perforator displacement mechanism;

a perforator controller for controlling operation of the perforator displacement mechanism; and a perforator timer configured to activate the perforator displacement mechanism after expiration of a predetermined time period.

6. The downhole tool of claim 5, wherein a completion signal is received at the perforator controller when the plug transitions to the plugging state, and wherein the perforator timer is activated upon receipt of the completion signal.

7. The downhole tool of claim 5, wherein the predetermined time period comprises an estimated amount of time to permit disconnection of the downhole tool from a conveyance that conveys the downhole tool into the production tubing.

8. The downhole tool of claim 1, wherein the downhole tool is run into the production tubing on a conveyance, and a running tool interposes the conveyance and the downhole tool, and wherein the running tool is operatively coupled to the downhole tool with a frangible connector.

9. The downhole tool of claim 8, wherein the frangible connector comprises shear pin configured to shear after the plug transitions to the plugging state and upon assuming an overpull load provided by the conveyance.

10. The downhole tool of claim 1, wherein a profile is provided within the housing and is sized to receive and mate with a latching mechanism provided on a distal end of a retrieving tool, and wherein, once the latching mechanism locates and is received within the profile, an uphole force applied to the retrieving tool at the profile causes the plug to transition from the plugging state to the running state.

11. A method for preparing a well for the introduction of a kill fluid, the method comprising:

setting a plug control timer of a downhole tool to activate a plug displacement mechanism of the downhole tool after expiration of a predetermined time period;

conveying the downhole tool into production tubing on a conveyance extended from a surface installation, the production tubing being arranged within a wellbore extending from the surface installation and the downhole tool including:

a plugging portion including the plug controller and the plug control timer in communication with the plug controller, and further including a plug transitionable between a running state, where the plug is retracted and allows the downhole tool to traverse an interior of the production tubing, and a plugging state, where the plug expands radially outward to sealingly engage an inner wall of the production tubing; and a perforating portion operatively coupled to the plugging portion and providing a housing that houses a perforating device, wherein the housing is translatable relative to the plugging portion between a first axial position and a second axial position;

lowering the downhole tool to a predetermined depth within the production tubing;

allowing the predetermined time period to expire once the downhole tool reaches the predetermined depth;

transitioning the plug from the running state to the plugging state and thereby sealingly engaging the inner wall of the production tubing by operating the plug displacement mechanism with the plug controller;

extending the housing from the first axial position to the second axial position; and actuating the perforating device and thereby generating a perforation in the inner wall after extending the housing to the second axial position.

12. The method of claim 11, wherein the conveyance is operatively coupled to the downhole tool with a running tool, and the running tool is operatively coupled to the downhole tool with a frangible connector, the method further comprising:

with the plug in the plugging state, pulling on the running tool until the frangible connector shears and thereby freeing the running tool from the downhole tool; and returning the running tool to the surface installation.

13. The method of claim 11, further comprising:

pumping a kill fluid into the production tubing; and conveying the kill fluid out of the production tubing via the perforation and into an annulus defined between the production tubing and an inner wall of the wellbore.

14. The method of claim 13, further comprising:

conveying a retrieving tool into the production tubing on the conveyance, the retrieving tool including a latching mechanism;

receiving the latching mechanism at a profile provided within the housing;

applying an uphole force on the retrieving tool at the profile and thereby causing the plug to transition from the plugging state back to the running state; and returning the downhole tool back to the surface installation on the conveyance.

15. The method of claim 11, wherein the perforating portion includes a perforator displacement mechanism operable to actuate the perforating device and including a perforator controller and a perforator timer, wherein actuating the perforating device includes:

receiving a completion signal at the perforator controller when the plug transitions to the plugging state;

setting the perforator timer with a predetermined time period upon receipt of the completion signal; and activating the perforator displacement mechanism after expiration of the predetermined time period.

16. The downhole tool of claim 1, wherein the perforating device is a blade pivotable from a stowed state to an extended state, and wherein the blade is rotatable about a longitudinal axis of the downhole tool to penetrate the inner wall of the production tubing.

17. A downhole tool, comprising:

a plugging portion including a plug transitionable between a running state, where the plug is retracted and allows the downhole tool to traverse an interior of production tubing, and a plugging state, where the plug expands radially outward to sealingly engage an inner wall of the production tubing; and a perforating portion operatively coupled to the plugging portion and providing a housing that houses a perforating device actuatable to penetrate the inner wall of the production tubing and thereby generate a perforation through which a kill fluid may be circulated into an annulus surrounding the production tubing, wherein a profile is provided within the housing and is sized to receive and mate with a latching mechanism provided on a distal end of a retrieving tool, and wherein, once the latching mechanism locates and is received within the profile, an uphole force applied to the retrieving tool at the profile causes the plug to transition from the plugging state to the running state.

18. The downhole tool of claim 17, wherein the plugging portion further includes a plug displacement mechanism operable to transition the plug between the running and plugging states.

19. The downhole tool of claim 18, wherein the plug displacement mechanism includes:

a plug controller operable to control operation of the plug displacement mechanism; and a plug control timer in communication with the plug controller, the plug control timer being configured to activate the plug displacement mechanism via the plug controller after expiration of a predetermined time period.

20. The downhole tool of claim 17, wherein the perforating device is a blade pivotable from a stowed state to an extended state, and wherein the blade is rotatable about a longitudinal axis of the downhole tool to penetrate the inner wall of the production tubing.

* * * * *